US006305307B1

(12) United States Patent
Yokoya

(10) Patent No.: US 6,305,307 B1
(45) Date of Patent: Oct. 23, 2001

(54) BRAKING SYSTEM FOR SMALL JET PROPULSION SURFBOARD

(75) Inventor: Noboru Yokoya, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/536,978

(22) Filed: Mar. 29, 2000

(30) Foreign Application Priority Data

Mar. 29, 1999 (JP) ..... 11-087270

(51) Int. Cl.[7] ..... B63H 25/44
(52) U.S. Cl. ..... 114/145 R; 114/55.5
(58) Field of Search ..... 114/145 R, 145 A, 114/55.5, 123, 311; 440/38, 40, 41, 42

(56) References Cited

U.S. PATENT DOCUMENTS 1,863,944 * 6/1932 Semmes ..... 114/145 R
5,813,357 * 9/1998 Watson ..... 114/145 R
5,970,898 * 10/1999 Pereira ..... 114/145 R
5,988,091 * 11/1999 Willis ..... 114/145 R
6,032,605 * 3/2000 Takashima ..... 114/123

FOREIGN PATENT DOCUMENTS 61-253296 * 11/1986 (JP) ..... 114/145 R
1-109499 7/1989 (JP) .

* cited by examiner

*Primary Examiner*—Stephen Avila
(74) *Attorney, Agent, or Firm*—Birch, Stewart, Kolasch & Birch, LLP

(57) ABSTRACT

A braking system for a small jet propulsion surfboard can be manufactured at reduced costs. The braking system includes left and right sponsons retractably attached to a surfboard body. Left and right locking units fix the sponsons to the surfboard body. An unlocking unit unlocks the lock units in order to free the sponsons from the surfboard body. A traction rope ensures that the freed sponsons remain connected to the surfboard body. The freed sponsons are pulled by the traction rope to thereby apply braking force to the jet propulsion surfboard. In an alternative embodiment, a system with a water-reversing cup can replace the sponsons.

25 Claims, 10 Drawing Sheets

BRAKING SYSTEM FOR SMALL JET PROPULSION SURFBOARD

BACKGROUND OF THE INVENTION

1. Field of the Invention

The invention relates to a braking system for applying braking force to a small jet propulsion surfboard when pulled by a traction rope.

2. Description of the Related Art

Some small surfboards are power-driven and jet-propelled as disclosed in Japanese Utility Model Laid-Open No. Hei 1-109499, entitled "Self-circling system for Surfboard", which will be partially described with reference to FIGS. 10(*a*) and 10(*b*) of the accompanying drawings.

FIGS. 10(*a*) and 10(*b*) show an example of how power-driven surfboards operate. Referring to FIG. 10(*a*), an engine is housed in a projecting part 151 at the rear part of a surfboard 150. The engine is activated in order to cause jet propulsion. A rider 152 on the surfboard 150 holds a grip 155 at the upper end of a rope 154 with their left hand in order to balance and slide the surfboard 150 on the water. The rope 154 is provided with a resisting member 156 near the grip 155.

As shown in FIG. 10(*b*), when the rider 152 falls from the surfboard 150 into the water, the rope 154 also falls into the water, thereby allowing the resisting member 156 to open in the water, which applies braking force to the surfboard 150, making the surfboard 150 turn in a direction shown by an arrow a. This prevents the surfboard 150 and the rider 152 from becoming separated.

There is a surfboard which is operated by jet propulsion and handled just like a motorcycle (such a boat is referred to as a "jet propulsion surfboard"). With the jet propulsion surfboard, the rider sits on a seat, grips opposite ends of a steering handlebar with both hands, advances the surfboard by operating an accelerator lever at the right end of the steering handlebar, and decelerates the surfboard or moves it backward by operating a lever at the left end of the steering handlebar. This jet propulsion surfboard is usually larger than the foregoing power-driven surfboard.

The jet propulsion surfboard may be able to efficiently decelerate or turn itself if it is provided with a component corresponding to the resisting member 156 of the cited reference No. Hei 1-109499 (hereinafter the component referred to as a "braking system").

However, since a jet propulsion surfboard is usually larger than a power-driven surfboard, its braking system has to be large in order to allow efficient deceleration or turning, compared with the resisting member 156 of the power-driven surfboard 150. The larger the braking system becomes, the more complicated it becomes in order to maintain the strength of the braking system. Therefore, installation of the braking system on the jet propulsion surfboard increases the number of components, weight and cost.

SUMMARY OF THE INVENTION

It is an object of the present invention to provide a braking system for a small jet propulsion surfboard Which is light-weight and cheaper to manufacture.

According to a first feature, there is provided a braking system for a small jet propulsion surfboard, comprising: a braking unit retractably attached to a surfboard body; a locking unit for fixing the braking unit to the surfboard body; an unlocking unit for unlocking the locking part for the purpose of freeing the braking unit; and a traction rope for keeping the braking unit connected to the surfboard body. The braking unit in the water is pulled by the traction rope and applies braking force to the surfboard body.

The braking unit is freed from the surfboard body into the water, and is pulled by the traction rope in order to apply braking force to the surfboard. The braking unit can be made of a minimum number of components.

In accordance with a second feature, the braking unit includes a pair of sponsons attached to opposite sides of the surfboard body. The sponsons are short wings horizontally projecting from the surfboard body in order to stabilize the surfboard. When braking the surfboard, either the right or left sponson is unlocked from the surfboard body, and is pulled by the traction rope.

According to a third feature, the braking unit is a water-reversing cup attached to a nozzle for injecting water rearward from a bilge, and reversing injected water.

When braking the surfboard, either the right or left sponson is unlocked from the surfboard body, and is pulled by the traction rope. Alternatively, both sposons can be released to brake the surfboard while permitting it to continue to travel in a straight path.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4(*b*) is a side view of the first operation of the braking system according to the first embodiment;

FIG. 10(*b*) shows the background art surfboard with the rider having fallen off.

DETAILED DESCRIPTION OF THE PREFERRED EMBODIMENTS

Figure 1:
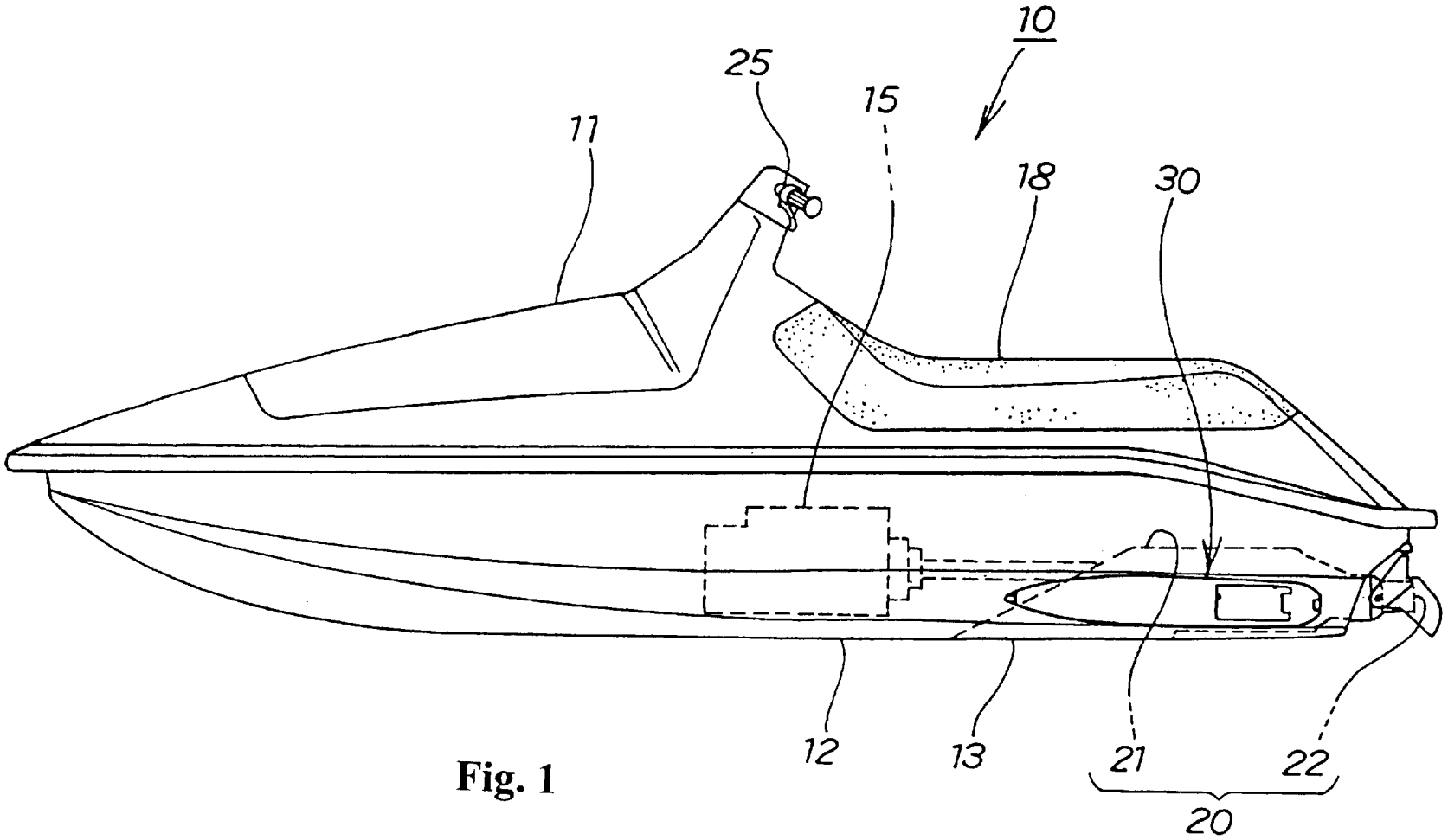
FIG. 1 is a side elevation of a jet propulsion surfboard including a braking system according to a first embodiment of the invention.

The invention will be described with reference to preferred embodiments shown in the accompanying drawings. In FIG. 1, a side elevation of a jet propulsion surfboard 10 is shown. This surfboard has a braking system according to a first embodiment of the invention. The surfboard 10 includes an engine 15 installed substantially at the center of a surfboard body 11 and a jet propeller 20 for injecting water sucked via an opening 13 on a bilge 12 to the rear part of the surfboard body 11 in response to the operation of the engine 15. A steering handlebar 25 for steering the surfboard body 11, a braking system 30 and a seat 18 are also provided. The braking system 30 applies braking force to the jet propulsion surfboard 10 when a braking unit in the water is pulled by a traction rope.

The braking unit is unlocked from the surfboard body 11 into the water, and is pulled by the traction rope, thereby applying braking force to the jet propulsion surfboard 10. The braking unit can be made of a minimum number of components, and manufactured at a reduced cost.

The jet propeller 20 has a housing 21 extending between the opening 13 on the bilge 12 and the rear part of the surfboard body 11. The housing 21 has an impeller (not shown) rotatably housed therein, and a nozzle 22 arranged at the rear end thereof. The nozzle 22 is swingable in a turning direction of the surfboard 10. When the engine 15 is activated to rotate the impeller, water is sucked via the opening 13 on the bilge 12, is guided to the rear part of the surfboard body 11, and is injected via the nozzle 22 to the rear part of the surfboard body 11, thereby causing jet propulsion.

Figure 2:
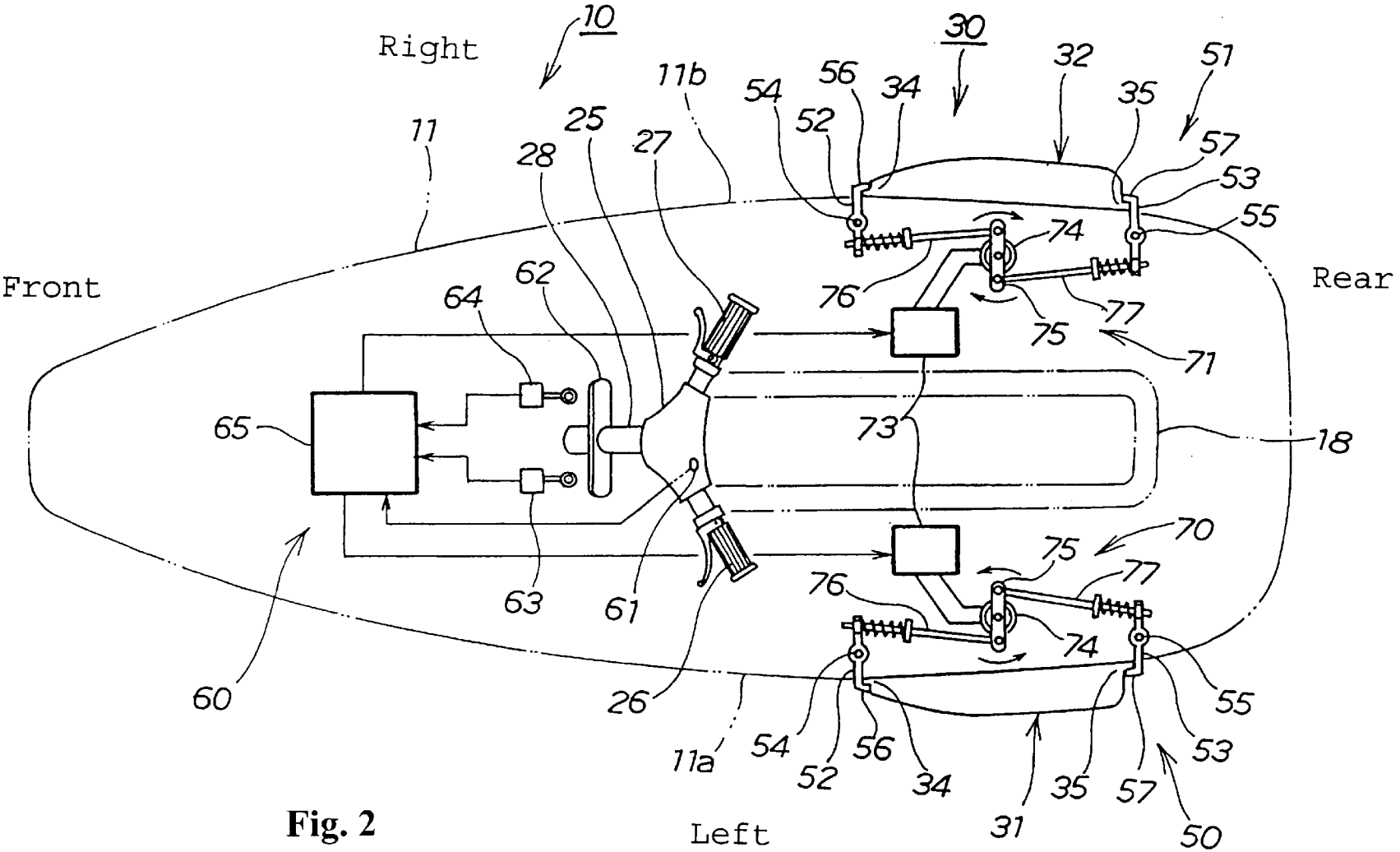
FIG. 2 is a top, plan view of the braking system for the jet propulsion surfboard, according to the first embodiment.

A steering handlebar 25 is operably installed substantially at the center of the surfboard body 11. This handlebar 25 steers the surfboard 10 to the left or right when the left or right hand grip 26 or 27 is turned to the left or right. Both hand grips 26, 27 are shown in FIG. 2.

The braking system 30 includes left and right sponsons 31 and 32 retractably attached on left and right sides 1 la and 1 lb of the surfboard body 11. Left and right locking units 50 and 51 for locking the sponsons 31 and 32 to the left and right sides 11*a* and 11*b* of the surfboard body 11 are also provided as a part of the braking system 30. This braking system 30 also includes an unlocking unit 60 for unlocking the locking units 50 and 51 in order to free the sponsons 31 and 32 and a traction rope 80 (see FIG. 3) for maintaining the freed sponsons 31 and 32 connected to the surfboard body 11. The sponsons 31 and 32 in the water are pulled by the traction rope 80 in order to brake the surfboard 10. The sponsons 31 and 32 project from the left and right sides 11*a* and 11*b* in order to stabilize the surfboard 10.

As described above, the sponsons 31 and 32 project from the left and right sides 11*a* and 11*b* of the surfboard body 11, and can be easily freed from the surfboard body 11. This means that the left and right locking units 50 and 51 can have a simple structure in order to retractably attach the sponsons 31 and 32 to the surfboard body 11.

The sponsons 31 and 32 have the same structure, and the locking units 50 and 51 also have the same structure. Therefore, only the left sponson 31 and the left locking unit 50 will now be described hereinafter. The left sponson 31 will be detailed with reference to FIG. 3.

In the left locking unit 50, front and rear lock arms 52 and 53 are rotatably attached to the surfboard body 11 via front and rear pins 54 and 55, and front ends 56 and 57 of the front and rear lock arms 52 and 53 are hooked with front and rear ends of the left sponson 31. Therefore, the left sponson 31 is fixed to the left side 11*a* of the surfboard body 11.

The unlocking unit 60 unlocks the left and right locking units 50 and 51 in order to free the left and right sponsons 31 and 32. The unlocking unit 60 includes a braking button 61 attached to the steering handlebar 25, an operating plate 62 attached on a rotary shaft 28 of the steering handlebar 25 and turn sensors 63 and 64 which come into contact with the operating plate 62 when the steering handlebar 25 is turned to the left or right for a predetermined extent. The unlocking unit also includes a controller 65 for producing an unlock signal in response to a turn signal from the turn sensor 63 or 64 and a braking signal from the braking button 61. Left and right unlocking parts 70 and 71 for unlocking the left or right locking part 50 or 51 in response to the unlock signal from the controller 65 are also provided in the unlocking unit 60.

Since the left and right unlocking parts 70 and 71 are identical, only the left unlocking part 70 will now be described hereinafter. The left unlocking part 70 generates oil pressure in an oil pressure generator 73 in response to the unlock signal from the controller 65. The generated oil pressure turns a hydraulic motor 74 by a predetermined angle as shown by arrows. Rotating force of the hydraulic motor 74 is transmitted to a rotary lever 75, front and rear rods 76 and 77, and front and rear lock arms 52 and 53 (of the left locking unit 50), so that the front and rear lock arms 52 and 53 are opened to free the left sponson 31 from the left side I1 a of the surfboard body 11.

When the braking button 61 is pressed with the steering handlebar 25 turned to the left, the left sponson 31 will be unlocked from the left side 11*a* of the surfboard body 11. Conversely, when the braking button 61 is pressed with the handlebar 25 turned to the right, the right sponson 32 will be unlocked from the right side 11*b* of the surfboard body 11. Therefore, if either the left or right sponson 31 or 32 is unlocked, the jet propulsion surfboard 10 will be turned to the left or right.

On the other hand, if the braking button 61 is pressed during non-turning of the steering handlebar 25, both of the left and right sponsons 31 and 32 will be simultaneously unlocked from the left and right sides 11*a* and 11*b* of the surfboard body 11, which enables the surfboard 10 to be braked when moving in a straight line.

Figure 3:
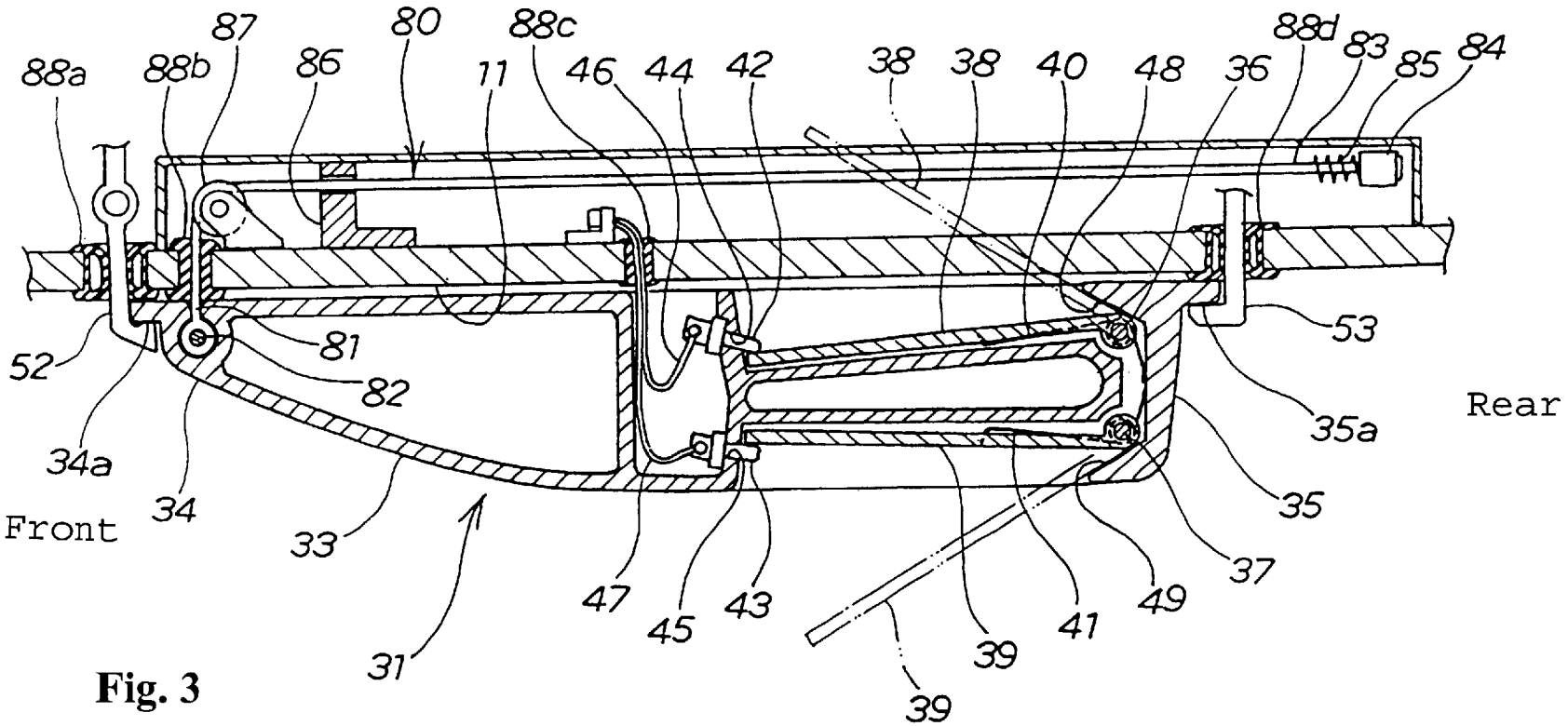
FIG. 3 is an enlarged view of the essential parts of the braking system according to the first embodiment of the invention.

As shown in FIG. 3, the sponson 31 includes a sponson body 33 that is substantially in the shape of a boat, and is provided with front and rear recesses or dents 34*a* and 35*a* to which the front and rear lock arms 52 and 53 are hooked. These recesses 34*a* and 35*a* are positioned at the front and rear ends 34 and 35 of the sponson body 33. Inner and outer openable plates 38 and 39 are movably attached to the rear end 35 of the sponson body 33 via inner and outer pins 36 and 37. Torsion springs 40 and 41 for opening the plates 38 and 38 are housed in the inner and outer pins 36 and 37. Inner and outer lock pins 42 and 43 for locking the plates 38 and 39 at a closed position are fitted into inner and outer openings 44 and 45 of the left sponson 31. The lock pins 42 and 43 are tied to the surfboard body 11 using inner and outer ropes 46 and 47.

A traction rope 80 includes a tip 81 which comes out of the surfboard body 11 and is tied to the front end 34 of the sponson body 33 via a pin 82. A stop 84 and a compression spring 85 at its base end 83. When the left sponson 31 is unlocked from the surfboard body 11, the compression spring 85 is brought into contact with a block 86 of the surfboard body 11 in order to prevent the traction rope 80 from being disconnected from the surfboard body 11. A pulley 87 is provided for guiding the traction rope 80. Seals 88*a* to 88*d* are also provided.

When the left sponson 31 is freed from the surfboard body 11, the inner and outer lock pins 42 and 43 come out of the inner and outer openings 44 and 45, and the plates 38 and 39 are opened by force of the inner and outer springs 40 and 41, and stopped when they come into contact with the stops 48 and 49. Therefore, the plates 38 and 39 are opened to the positions shown by phantom lines.

Figure 4:
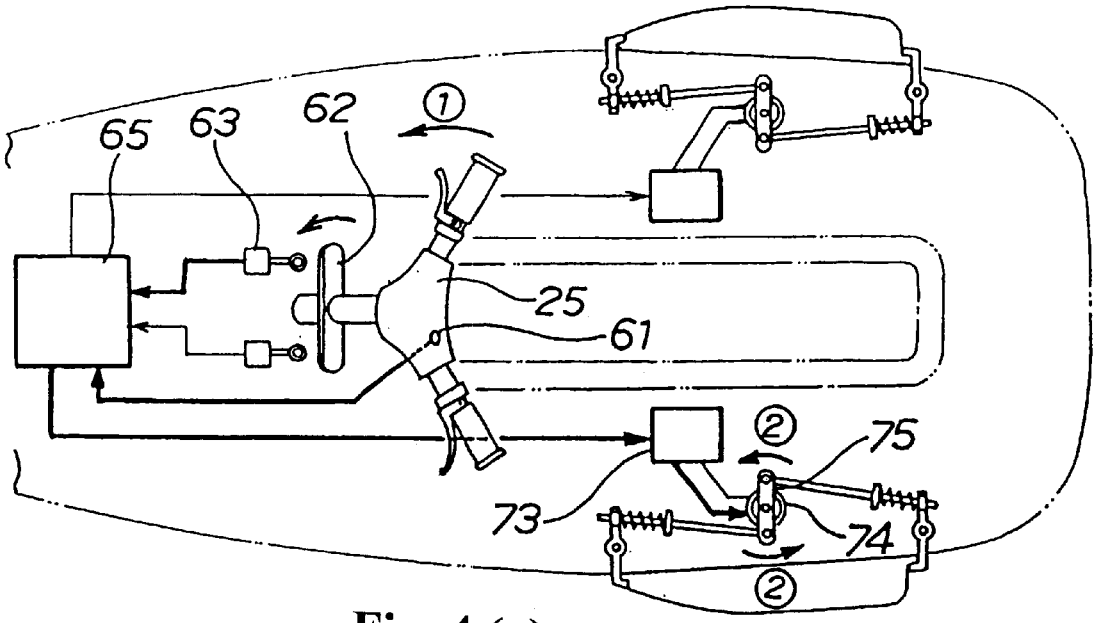
FIG. 4(*a*) is a plan view of a first operation of the braking system of the first embodiment.
Figure 4:
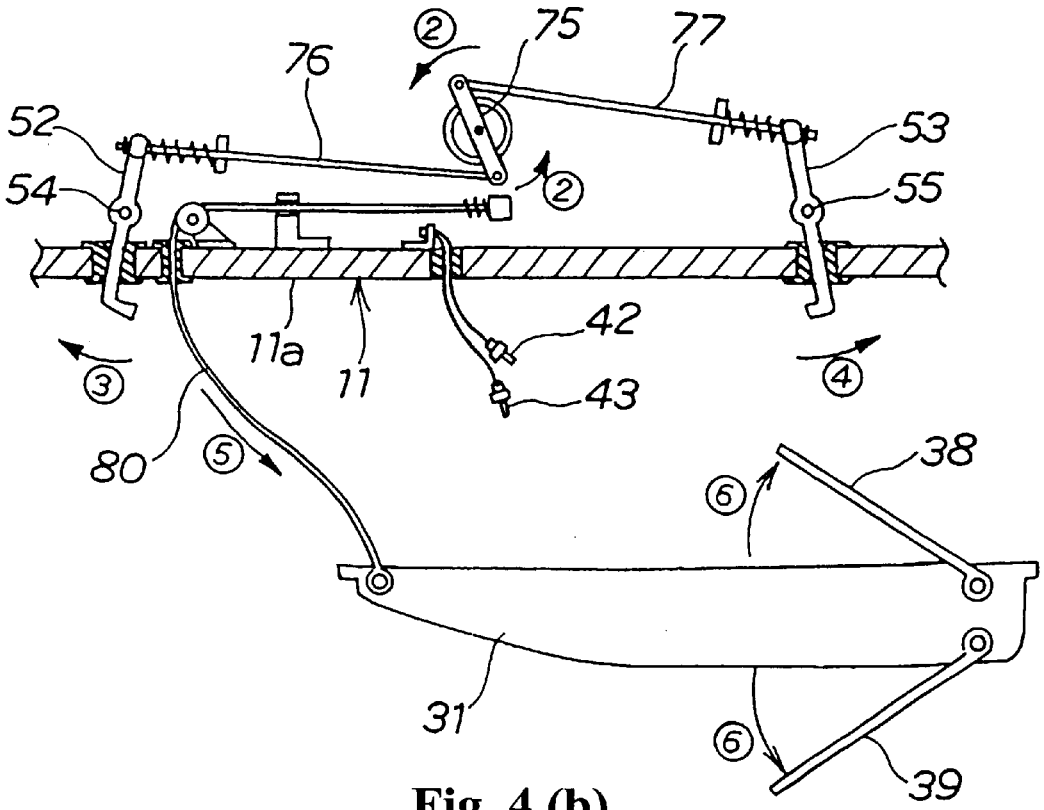

Referring now to FIG. 4(*a*), when the steering handlebar 25 is turned to the left as shown by an arrow (1), the operation plate 62 is turned as shown by an arrow and comes into contact with the left turn sensor 63. A turn signal is then transmitted to the controller 65. At the same time, the braking button 61 is pressed in order to transmit a braking signal to the control unit 65.

The control unit 65 provides the oil pressure generator 73 with an unlock signal. Oil pressure generated by the oil pressure generator 73 turns the hydraulic motor 74 by a predetermined angle, thereby turning the rotary lever 75 as shown by arrows (2).

Referring to FIG. 4(*b*), rotational force of the rotary lever 75 is transmitted to the front and rear rods 76 and 77, and front and rear lock arms 52 and 53 (of the left locking unit 50), thereby pivoting the front and rear lock arms 52 and 53 on the front and rear pins 54 and 55 as shown by arrows (3) and (4). Then, the left sponson 31 is unlocked from the left side 11*a* of the surfboard body 11.

Thereafter, the traction rope 80 is pulled by the left sponson 31 unlocked from the surfboard body 11 as shown by an arrow (5). Then, the inner and outer lock pins 42 and 43 come out of the inner and outer openings 44 and 45 (shown in FIG. 3) of the left sponson 31, so that the inner and outer plates 38 and 39 will be opened as shown by arrows (6).

Figure 5:
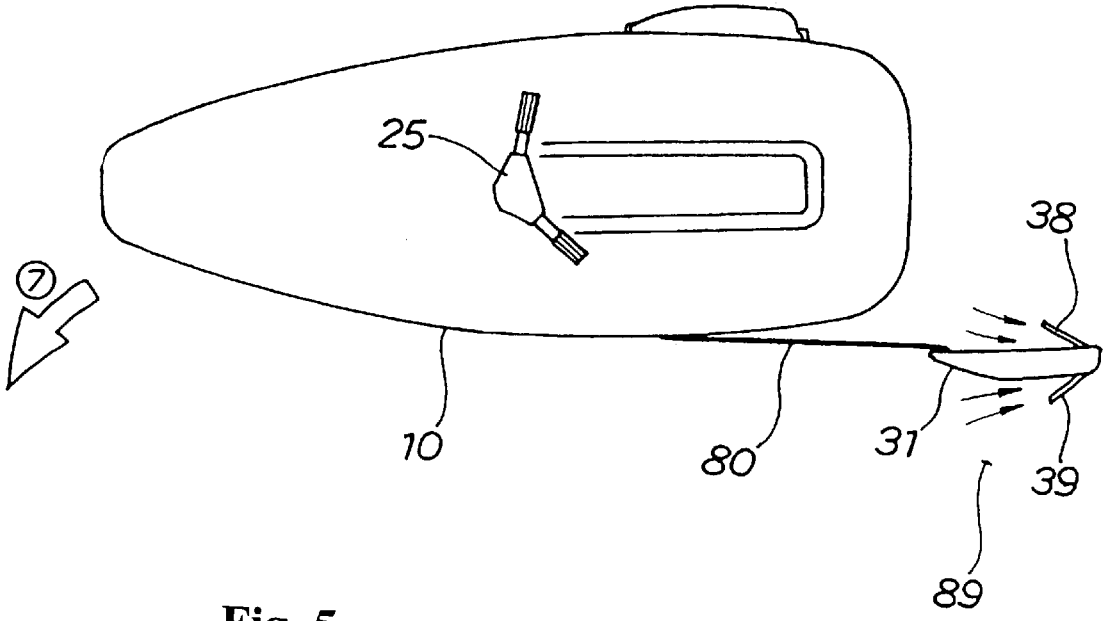
FIG. 5 shows a second operation of the braking system according to the first embodiment of the surfboard of the present invention.

As shown in FIG. 5, the left sponson 31 in the water 89 is pulled by the traction rope 80, and applies braking force to the left side of the jet propulsion surfboard 10. As a result, the surfboard 10 turns to the left as shown by an arrow (7).

Figure 6:
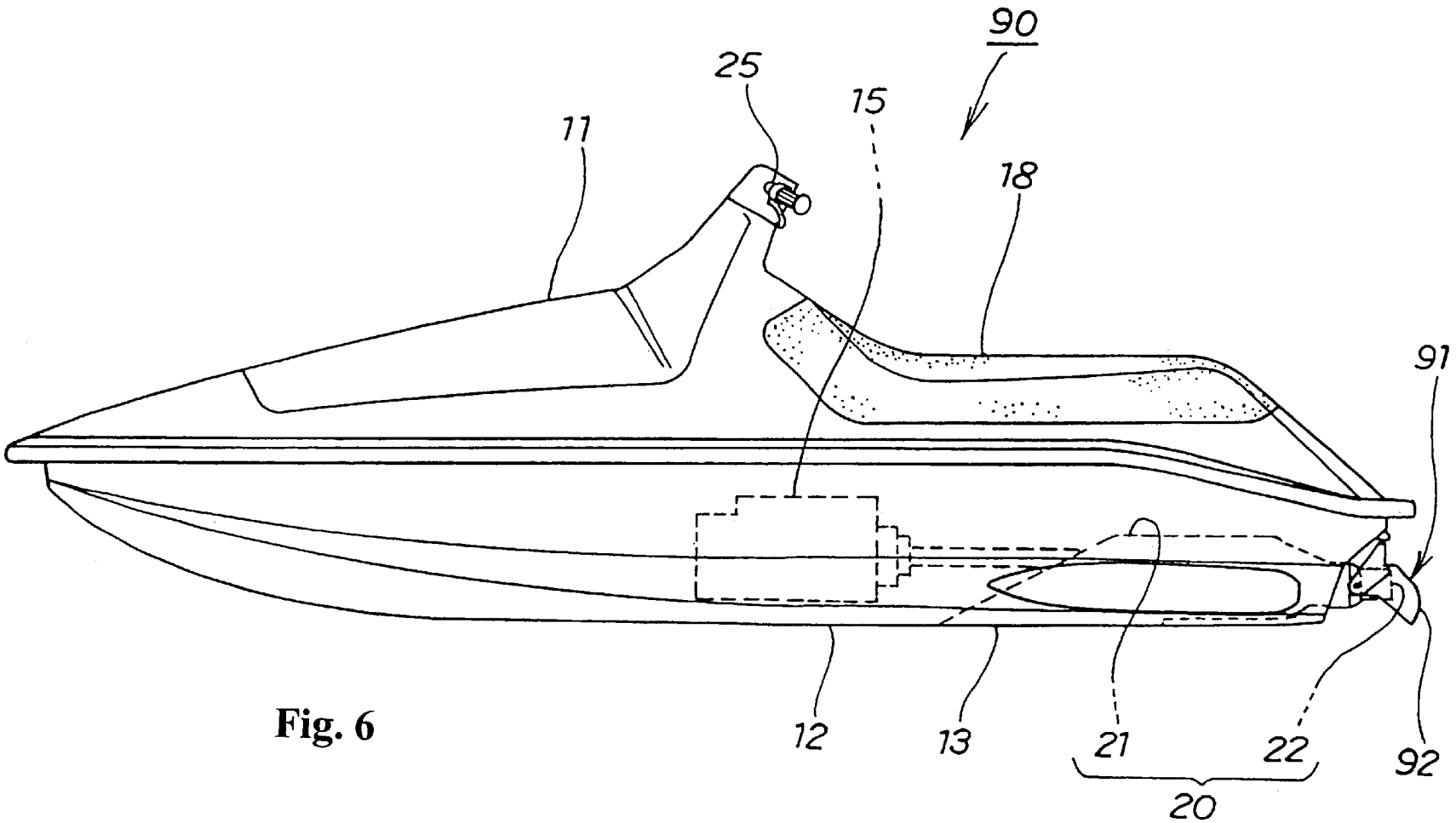
FIG. 6 is a side elevation of the braking system for the surfboard according to the second embodiment of the invention.

Next, the invention will be described with reference to a second embodiment of FIG. 6. Like or corresponding parts are denoted by like or corresponding reference numerals, and will not be described in detail.

The second embodiment is identical to the first embodiment except that a small jet propulsion surfboard 90 is provided with a braking system 91 in place of the braking system 30 of the first embodiment.

Figure 7:
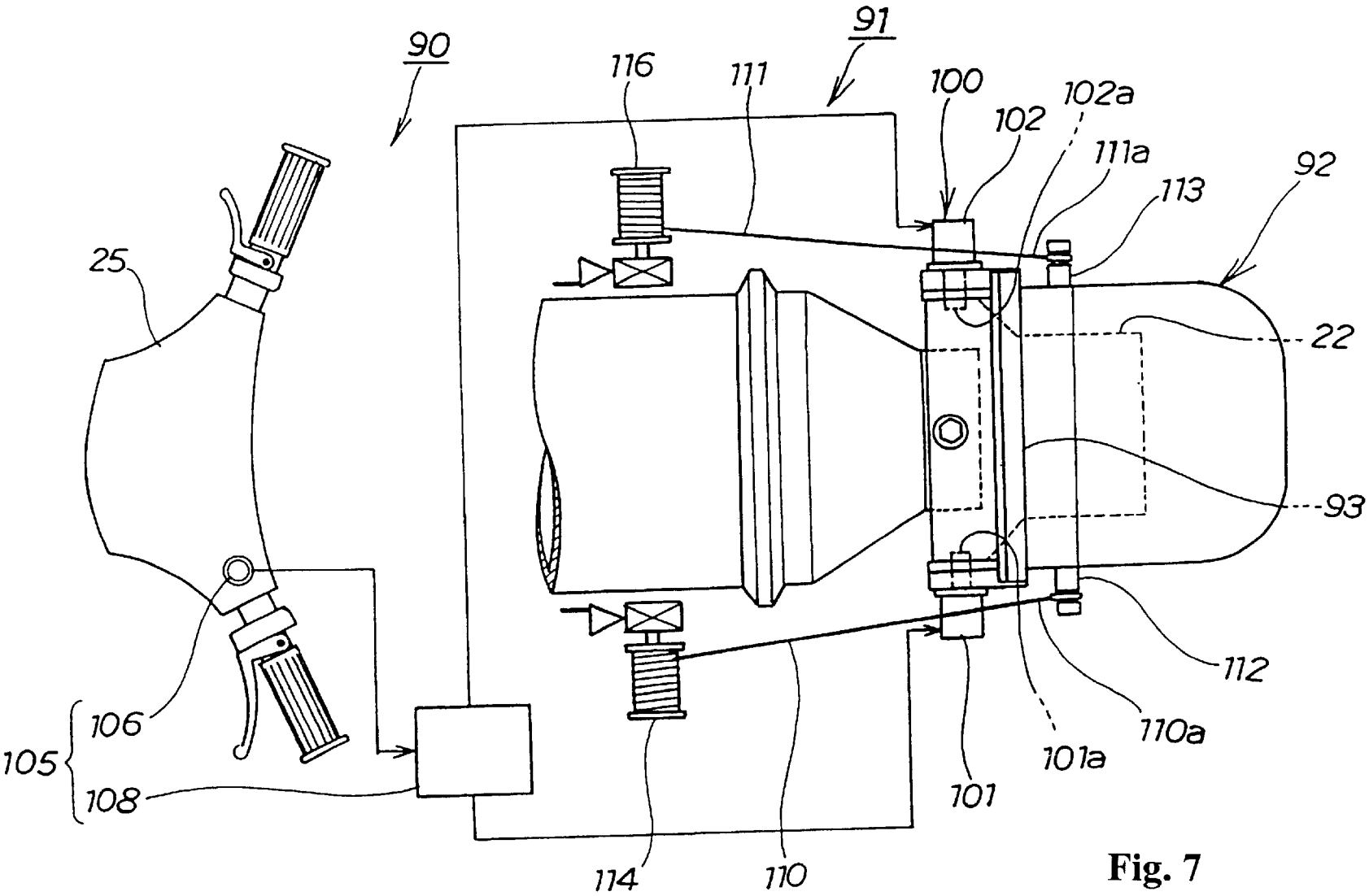
FIG. 7 is a top, plan view of the braking system of the second embodiment of the present invention.

The braking system 91 of the second embodiment shown in FIG. 7 includes a water-reversing cup 92 attached to a nozzle 22 of the jet propulsion surfboard 90. A locking unit 100 for attaching the water-reversing cup 92 to the nozzle 22 is also provided. An unlocking unit 105 for unlocking the locking unit 100 in order to free the cup 92 from the surfboard body 11 and left and right traction ropes 110 and 111 for keeping the freed cup 92 connected to the surfboard body 11 are also provided. The cup 92 is pulled by the traction ropes 110 and 111 so as to brake the jet propulsion surfboard 90.

Specifically, the braking system 91 has the water-reversing cup 92 retractably attached to the surfboard body 11 in place of the left and right sponsons of the first embodiment. The cup 92 is provided on the surfboard 90, and is made of a reduced number of components, which is effective in reducing weight and cost of the braking system.

The water-reversing cup 92 will now be described in more detailed with reference to FIG. 8. The nozzle 22 for injecting water rearward is exposed on the outer surface of the surfboard body 11. Therefore, the cup 82 is retractably attached to the nozzle 22 using the locking unit 100 having a simple structure, and can be easily freed from the nozzle 22. The lock unit 100 swingably attaches the water-reversing cup 92 to the nozzle 22 using pins lOla and 102a projecting from left and right attaching parts 101 and 102. The unlocking unit 105 unlocks the lock unit 100 in order to free the water-reversing cup 92 from the surfboard body 11, and includes a braking button 106 coupled to the steering handlebar 25, and a control unit 108 for issuing an unlock signal in response to a braking signal from the braking button 106.

The left traction rope 110 is wound around a left winch 114 and has its tip 110*a* connected to a left pin 112 of the water-reversing cup 92. The right traction rope 111 is wound around a right winch 116 and has its tip 111*a* connected to a right pin 113. When the water-reversing cup 92 is freed from the nozzle 22, the traction ropes 110 and 111 are unreeled from the winches 114 and 116, thereby pulling the water-reversing cup 92.

Figure 8:
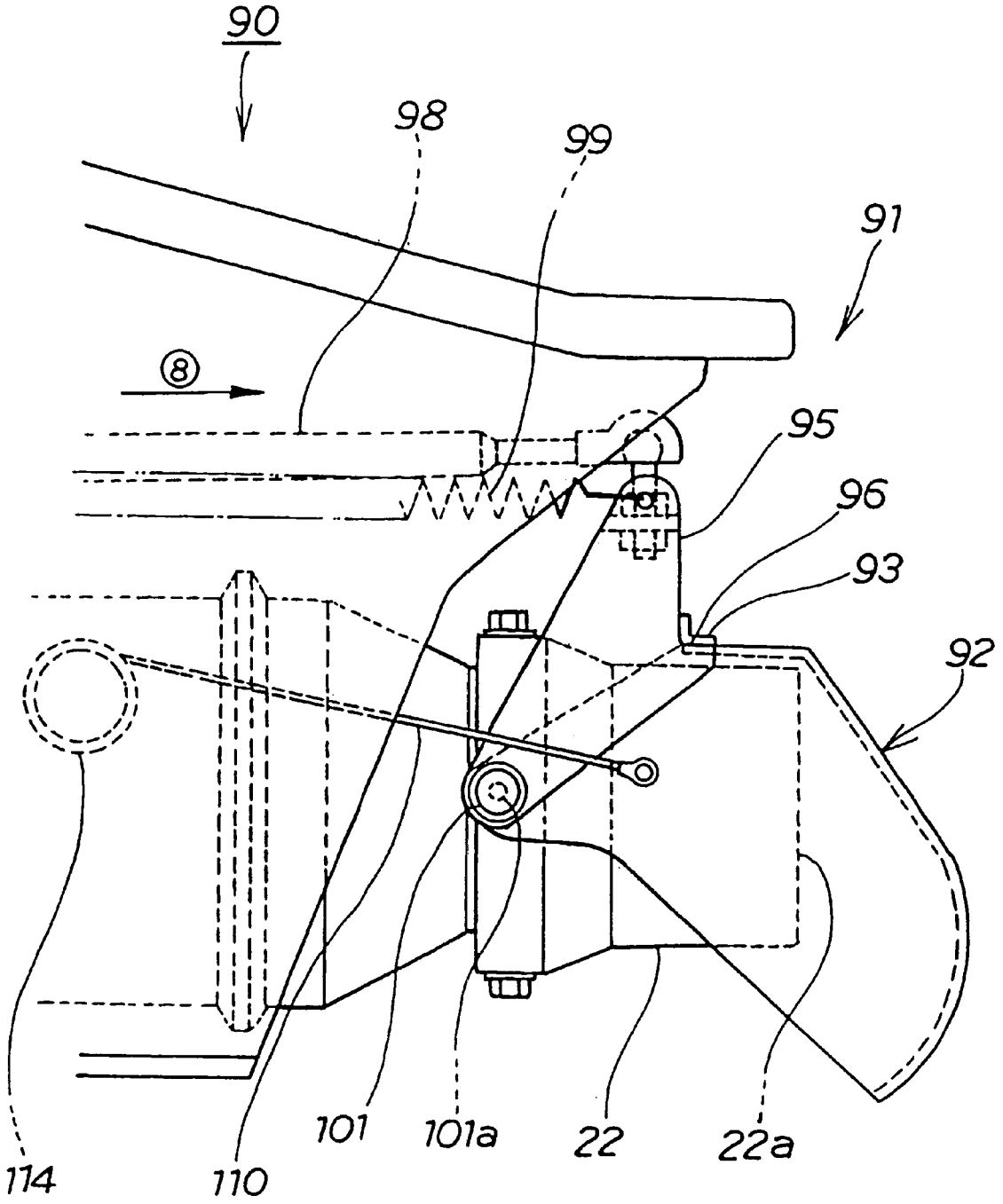
FIG. 8 is a side view of the braking system of the second embodiment.

As seen in FIG. 8, the water-reversing cup 92 faces an outlet of the nozzle 22 and will therefore reverse a direction of injected water in order to move the jet propulsion surfboard backward or decelerate it. The reversing cup 92 is retractably attached using the lock pins 101*a* and 102*a* of the left and right lock units 101 and 102 (only the pin 101*a* is shown in FIG. 8).

The water-reversing cup 92 is attached at its upper end to an operation plate 95 using an angle iron 93 (also shown in FIG. 7) fitted in a recess 96 of the operation plate 95, so that the water-reversing cup 92 is swingable as an integral part of the operation plate 95. Therefore, when a rod 98 is pushed in the direction of an arrow (8), the operation plate 95 swings on the pins 101*a* and 102*a* of the left and right attaching parts 101 and 102, thereby enabling the water-reversing cup 92 to face the outlet 22*a* of the nozzle 22. The water-reversing cup 92 is freed from the nozzle 22 and the operation plate 95 as the pins 101*a* and 102*a* retreat. In FIG. 8, reference numeral 99 denotes a return spring.

The operation of the braking system for the surfboard (in the second embodiment) will now be described. Referring to FIG. 7, when pushed on the steering handlebar 25, the braking button 25 provides a braking signal to the control unit 108, which sends an unlocking signal to the lock unit 100. Then, the pins 101*a* and 102*a* of the attaching parts 101 and 102 retreat, freeing the water-reversing cup 92 from the nozzle 22 and the operation plate 95, and letting it fall into the water.

Figure 9:
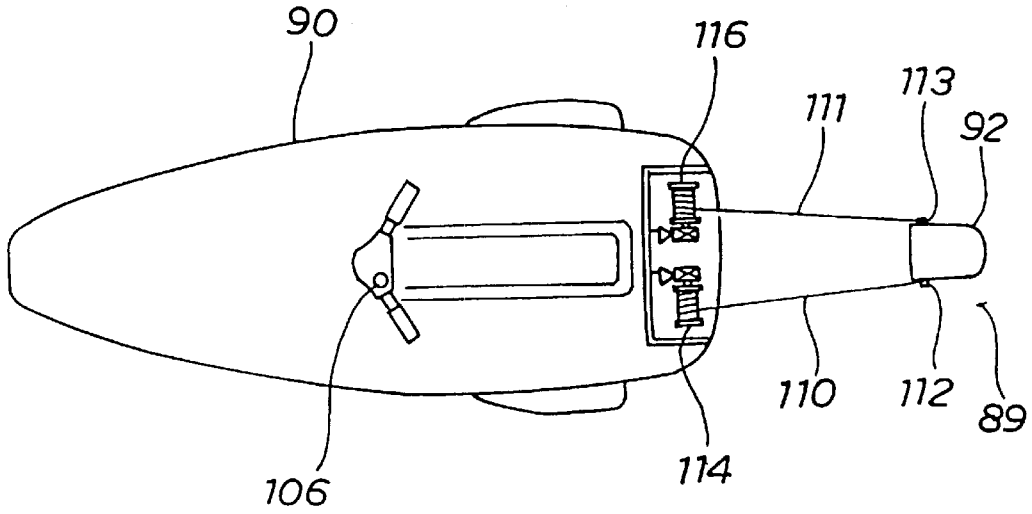
FIG. 9 shows the operation of the braking system of the second embodiment.
Figure 10:
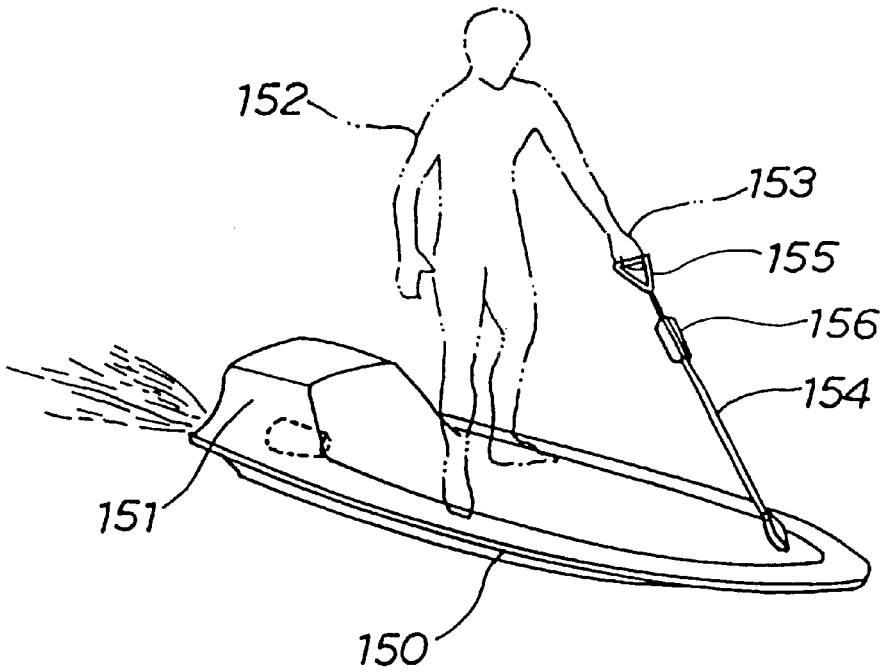
FIG. 10(*a*) shows the operation of a power-driven surfboard of the background art.
Figure 10:
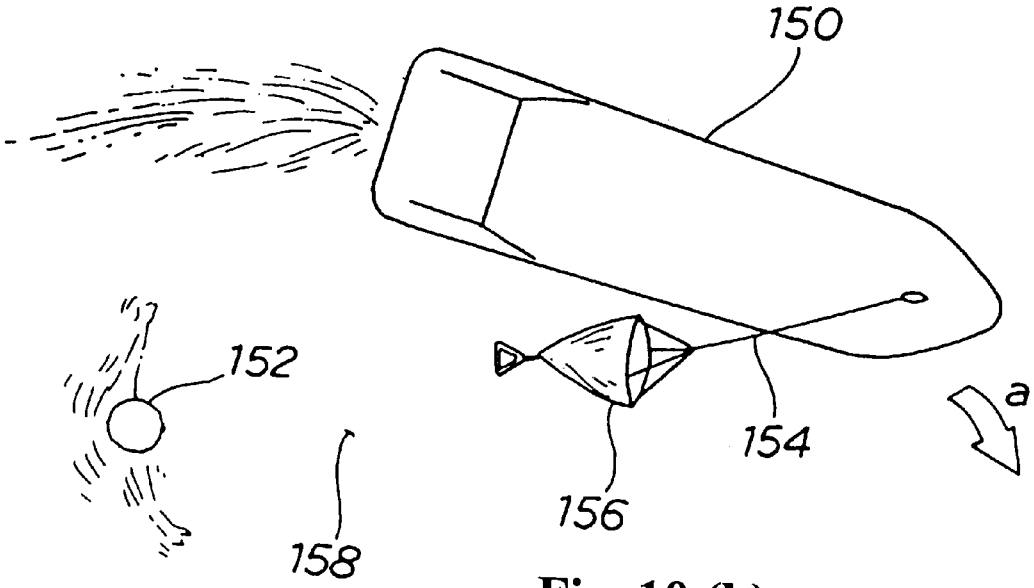

Braking force is applied to the jet propulsion surfboard 90 when the water-reversing cup 92 in the water is pulled by the traction ropes 110 and 111 as indicated in FIG. 9.

In the foregoing embodiments, the braking buttons 61 and 106 are provided on the steering handlebar 25. Alternatively, a braking lever or pedal may be used, for example.

The foregoing braking systems are effective in the following respects. The braking unit attached to the surfboard body is freed therefrom, and is pulled by the traction ropes in order to apply braking force to the surfboard. The braking system is composed of a minimum number of components, is light in weight, and is manufactured at a reduced cost.

Also, the braking unit includes the left and right sponsons, which are retractably attached to the surfboard body using relatively simple lock units. The sponsons project from the surfboard body. This structure is effective in reducing the manufacturing cost of the braking system. When either the left or right sponson is freed, the surfboard can be turned to the left or right.

Additionally, the braking system of the present invention includes the water injecting nozzle and the water-reversing cup which are attached on the outer surface of the surfboard body. The water-reversing cup can be easily freed from the surfboard body. The locking unit for retractably attaching the water-reversing cup to the nozzle has a relatively simple structure, which enables the manufacturing cost of the braking system to be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A braking system for a small jet propulsion surfboard, comprising:

a braking unit retractably attached on a surfboard body, the braking unit includes a pair of sponsons attached to opposite sides of the surfboard body;

a locking unit for fixing the braking unit to the surfboard body;

an unlocking unit for unlocking the locking unit for freeing the braking unit; and a traction rope for keeping the freed braking unit connected to the surfboard body, wherein the braking unit is pulled by the traction rope and applies braking force to the surfboard, the traction rope includes at least one traction rope and wherein each of the sponsons are tethered to the surfboard body by the at least one traction rope.

2. The braking system according to claim 1, wherein the traction rope is movable within the surfboard body when at least one of the sponsons is unlocked by the unlocking unit such that a released sponson moves away from the surfboard body while pulling the traction rope and wherein the braking system further includes a block within the surfboard body for stopping movement of the traction rope and for keeping the traction rope and sponson connected with the surfboard body.

3. The braking system according to claim 1, wherein the at least one sponson has at least one pivotable plate which moves to an open position when the unlocking unit unlocks the braking unit.

4. The braking system according to claim 1, wherein the locking unit includes a pair of lock arms for the braking unit, the pair of lock arms being movable in opposed directions to release the braking unit during unlocking.

5. The braking system according to claim 1, wherein the braking unit further includes a braking button on the surfboard body, at least one turn sensor and a controller, the controller receives a signal from at least one of the braking button and the at least one turn sensor in order to unlock the locking unit.

6. The braking system according to claim 1, wherein the surfboard body travels in a travel direction prior to braking and wherein the braking unit turns the surfboard in one of a left direction, a right direction or a straight direction upon being unlocked by the locking unit and being freed from the surfboard body, the right, left and straight directions being relative to the travel direction.

7. A braking system for a small jet propulsion surfboard, comprising:

a braking unit retractably attached on a surfboard body, the braking unit includes at least one sponson, the sponson having at least one pivotable plate which moves to an open position when the unlocking unit unlocks the braking unit;

a locking unit for fixing the braking unit to the surfboard body;

an unlocking unit for unlocking the locking unit for freeing the braking unit;

a traction rope for keeping the freed braking unit connected to the surfboard body, wherein the braking unit is pulled by the traction rope and applies braking force to the surfboard; and a pair of plates are provided for the at least one sponson, the plates being movable away from one another when moving to the open position, the plates being held in a closed position when the at least one sponson is locked on the surfboard body.

8. The braking system according to claim 7, further comprising a pair of lock pins for holding the plates in the closed position, the plates being removed from the lock pins when the locking unit unlocks the at least one sponson and the at least one sponson moves away from the surfboard body.

9. The braking system according to claim 7, wherein the locking unit includes a pair of lock arms for the braking unit, the pair of lock arms being movable in opposed directions to release the braking unit during unlocking.

10. The braking system according to claim 7, wherein the braking unit further includes a braking button on the surfboard body, at least one turn sensor and a controller, the controller receives a signal from at least one of the braking button and the at least one turn sensor in order to unlock the locking unit.

11. The braking system according to claim 7, wherein the surfboard body travels in a travel direction prior to braking and wherein the braking unit turns the surfboard in one of a left direction, a right direction or a straight direction upon being unlocked by the locking unit and being freed from the surfboard body, the right, left and straight directions being relative to the travel direction.

12. A braking system for a small jet propulsion surfboard, comprising:

a braking unit retractably attached on a surfboard body, the braking unit includes a pair of sponsons, each of the pair of sponsons having a pair of locking arms and one of the pair of locking arms being independently movable relative to another of the pair of locking arms in opposed directions to release the braking unit during unlocking;

a locking unit for fixing the braking unit to the surfboard body;

an unlocking unit for unlocking the locking unit for freeing the braking unit; and a traction rope for keeping the freed braking unit connected to the surfboard body, wherein the braking unit is pulled by the traction rope and applies braking force to the surfboard.

13. The braking system according to claim 12, wherein the traction rope includes at least one traction rope and wherein each of the sponsons are tethered to the surfboard body by the at least one traction rope.

14. The braking system according to claim 12, wherein the traction rope is movable within the surfboard body when at least one of the sponsons is unlocked by the unlocking unit such that a released sponson moves away from the surfboard body while pulling the traction rope and wherein the braking system further includes a block within the surfboard body for stopping movement of the traction rope and for keeping the traction rope and sponson connected with the surfboard body.

15. The braking system according to claim 12, wherein at least one of the sponsons has at least one pivotable plate which moves to an open position when the unlocking unit unlocks the braking unit.

16. The braking system according to claim 12, wherein the braking unit further includes a braking button on the surfboard body, at least one turn sensor and a controller, the controller receives a signal from at least one of the braking button and the at least one turn sensor in order to unlock the locking unit.

17. The braking system according to claim 12, wherein the surfboard body travels in a travel direction prior to braking and wherein the braking unit turns the surfboard in one of a left direction, a right direction or a straight direction upon being unlocked by the locking unit and being freed from the surfboard body, the right, left and straight directions being relative to the travel direction.

18. A braking system for a small jet propulsion surfboard, comprising:

a braking unit retractably attached on a surfboard body, the braking unit includes a braking button on the surfboard body, at least one turn sensor and a controller;

a locking unit for fixing the braking unit to the surfboard body;

an unlocking unit for unlocking the locking unit for freeing the braking unit; and a traction rope for keeping the freed braking unit connected to the surfboard body, wherein the braking unit is pulled by the traction rope and applies braking force to the surfboard, wherein the controller receives a signal from at least one of the braking button and the at least one turn sensor in order to unlock the locking unit and the at least one turn sensor includes a left and right turn sensor and wherein the braking unit includes a right and left sponson, the controller releases the left sponson in response to at least a signal from the left turn sensor, the controller releases the right sponson in response to at least a signal from the right turn sensor and the controller releases both sponsons upon receipt of a signal from the braking button and lack of receipt of a signal from the left and right turn sensor.

19. The braking system according to claim 18, wherein the traction rope is movable within the surfboard body when at least one of the sponsons is unlocked by the unlocking unit such that a released sponson moves away from the surfboard body while pulling the traction rope and wherein the braking system further includes a block within the surfboard body for stopping movement of the traction rope and for keeping the traction rope and sponson connected with the surfboard body.

20. The braking system according to claim 18, wherein at least one of the sponsons has at least one pivotable plate which moves to an open position when the unlocking unit unlocks the braking unit.

21. The braking system according to claim 18, wherein the locking unit includes a pair of lock arms for the braking unit, the pair of lock arms being movable in opposed directions to release the braking unit during unlocking.

22. The braking system according to claim 18, wherein the surfboard body travels in a travel direction prior to braking and wherein the braking unit turns the surfboard in one of a left direction, a right direction or a straight direction upon being unlocked by the locking unit and being freed from the surfboard body, the right, left and straight directions being relative to the travel direction.

23. A braking system for a small jet propulsion surfboard, comprising:

a braking unit retractably attached on a surfboard body, the braking unit includes a water-reversing cup which is attached to a nozzle for injecting water rearward from a bilge and reverses injected water;

a locking unit for fixing the braking unit to the surfboard body;

an unlocking unit for unlocking the locking unit for freeing the braking unit; and a traction rope for keeping the freed braking unit connected to the surfboard body, wherein the braking unit is pulled by the traction rope and applies braking force to the surfboard, the traction rope includes a pair of traction ropes attached to the water-reversing cup and wherein the braking system further comprises a pair of winches connected to respective traction ropes.

24. The braking system according to claim 23, wherein the locking unit includes a pair of pins adjacent an outlet nozzle of the surfboard body, the water-reversing cup being detachably mounted to the surfboard body by the pair of pins.

25. The braking system according to claim 23, wherein the unlocking unit includes a braking button and a control unit.

* * * * *